US011534674B2

(12) United States Patent
Owen et al.

(10) Patent No.: US 11,534,674 B2
(45) Date of Patent: Dec. 27, 2022

(54) DETACHABLE SKATE FRAME

(71) Applicants: Neil Owen, Guangdong (CN); FangYu Wu, Guangdong (CN)

(72) Inventors: Neil Owen, Guangdong (CN); FangYu Wu, Guangdong (CN)

( * ) Notice: Subject to any disclaimer, the term of this patent is extended or adjusted under 35 U.S.C. 154(b) by 190 days.

(21) Appl. No.: 17/156,028

(22) Filed: Jan. 22, 2021

(65) Prior Publication Data

US 2021/0138334 A1 May 13, 2021

Related U.S. Application Data

(63) Continuation-in-part of application No. 16/502,043, filed on Jul. 3, 2019, now abandoned.

(51) Int. Cl.

| | |
|---|---|
| ***A63C 1/16*** | (2006.01) |
| ***A43B 5/16*** | (2006.01) |
| ***A63C 17/18*** | (2006.01) |
| *A63C 17/00* | (2006.01) |
| *A63C 1/14* | (2006.01) |

(52) U.S. Cl.

CPC ..... *A63C 1/16* (2013.01); *A43B 5/1633* (2013.01); *A63C 1/14* (2013.01); *A63C 17/18* (2013.01); *A63C 2017/0053* (2013.01); *A63C 2203/065* (2013.01)

(58) Field of Classification Search

CPC .... A63C 1/08; A63C 1/16; A63C 1/14; A63C 1/22; A63C 17/18; A63C 17/20; A63C 2203/065; A63C 2203/06; A63C 2017/0053; A43B 5/1633

See application file for complete search history.

(56) References Cited

U.S. PATENT DOCUMENTS

| | | | | |
|---|---|---|---|---|
| 908,536 | A | 1/1909 | Arlund | |
| 2,998,260 | A | 8/1961 | Meyer | |
| 3,061,325 | A | 10/1962 | Glass | |
| 5,123,664 | A | 6/1992 | Demars | |
| 6,120,038 | A * | 9/2000 | Dong | A43B 5/1633 280/11.33 |

(Continued)

FOREIGN PATENT DOCUMENTS

| | | |
|---|---|---|
| DE | 9419948 U1 | 2/1995 |
| DE | 29808012 U1 | 7/1998 |

(Continued)

*Primary Examiner* — Steve Clemmons

(74) *Attorney, Agent, or Firm* — Muncy, Geissler, Olds & Lowe, P.C.

(57) ABSTRACT

A skate includes an inverted groove-shaped base secured to a boot and including front and rear pins; an elongated frame including front and rear sets of a transverse inner groove and a transverse open groove communicating with the transverse inner groove, and a threaded hole on the transverse open groove of the front set wherein either pin is disposed in the transverse inner groove and the elongated frame abuts an underside of the base; and a locking device including a spring biased block member disposed in the transverse open groove of the front set and having two projections at two ends respectively, a screw driven through a positioning member into the threaded hole to fasten the positioning member in the transverse open groove of the front set so that the block member abuts the front pin to block same in an assembled state.

5 Claims, 4 Drawing Sheets

(56) References Cited

U.S. PATENT DOCUMENTS

| | | | |
|---|---|---|---|
| 6,334,621 | B1 | 1/2002 | Chang |
| 6,382,638 | B1 | 5/2002 | Lee |
| 6,698,768 | B2 | 3/2004 | Chun-Cheng |
| 6,702,304 | B2 | 3/2004 | Chu |
| 6,729,629 | B2 | 5/2004 | Chi |
| 6,742,788 | B1 | 6/2004 | Li |
| 8,801,002 | B2 | 8/2014 | Adams |
| 8,882,114 | B2 | 11/2014 | Adams |
| 2010/0242308 | A1 | 9/2010 | Belles |
| 2013/0175771 | A1 | 7/2013 | Shepley |

FOREIGN PATENT DOCUMENTS

| | | | |
|---|---|---|---|
| EP | 1541203 | A1 | 6/2005 |
| FR | 2767651 | A1 | 3/1999 |

* cited by examiner

DETACHABLE SKATE FRAME

BACKGROUND OF THE INVENTION

Field of the Invention

The present invention is a CIP of application Ser. No. 16/502,043, filed Jul. 3, 2019, the entire contents of which are hereby incorporated by reference.

DESCRIPTION OF THE PRIOR ART

Attempts for providing a skate with a detachable frame are well known in the art. For example, U.S. Pat. No. 6,120,038 to Dong et al. discloses a skate having a shoe portion detachably secured to a plurality of longitudinally aligned skate wheels for traversing a surface. The shoe portion has a sole defining a toe end and a heel end. The skate further comprises a frame having an upper surface and a lower surface attached to the wheels; a heel latch member rotatably attached to the frame for receiving and coupling to a heel binding attachment surface located in the heel end of the sole; a toe latch member attached to the frame for receiving and coupling a toe binding member located in the toe end of the sole; and a lever arm attached to the heel latch member to selectively release or attach the shoe portion from the heel latch member. The heel latch member is rotatable about a vertical axis extending normal to the elongate direction of the frame. The heel latch member is rotatable between a locked position, wherein the heel attachment member is nested therein, and an open position, wherein the frame is detachable from the shoe portion to convert the skate into a conventional shoe.

While the device enjoys its success in the market, continuing improvements in the exploitation of detachable skate frame of this type are constantly being sought.

The present invention is, therefore, arisen to obviate or at least mitigate the above mentioned disadvantages.

SUMMARY OF THE INVENTION

It is therefore one object of the invention to provide a skate including a boot defining a widthwise direction; an inverted groove-shaped base secured to the boot and including front and rear pins; an elongated frame including front and rear sets of a transverse inner groove and a transverse open groove communicating with the transverse inner groove, and a threaded hole on the transverse open groove of the front set wherein either the front pin or the rear pin is disposed in the transverse inner groove and the elongated frame abuts an underside of the base, wherein the elongated frame further includes two lateral sides opposite in the widthwise direction, each of the transverse inner groove and the transverse open groove extends through the elongated frame along the widthwise direction and is parallel to an axial direction of one of the front pin and the rear pin that is disposed in the transverse inner groove; ground engaging means secured to the elongated frame; and a locking device including a spring biased block member disposed in the transverse open groove of the front set and having two projections at two ends respectively, the projections extending oppositely and projecting out of the two lateral sides of the elongated frame in the widthwise direction from two ends of the transverse open groove of the front set respectively, a positioning member partially disposed on the spring biased block member, and a threaded fastener driven through the positioning member into the threaded hole to fasten the positioning member in the transverse open groove of the front set so that the block member abuts the front pin to block same in an assembled state.

The above and other objects, features and advantages of the invention will become apparent from the following detailed description taken with the accompanying drawings.

DETAILED DESCRIPTION OF THE PREFERRED EMBODIMENTS

Figure 1:
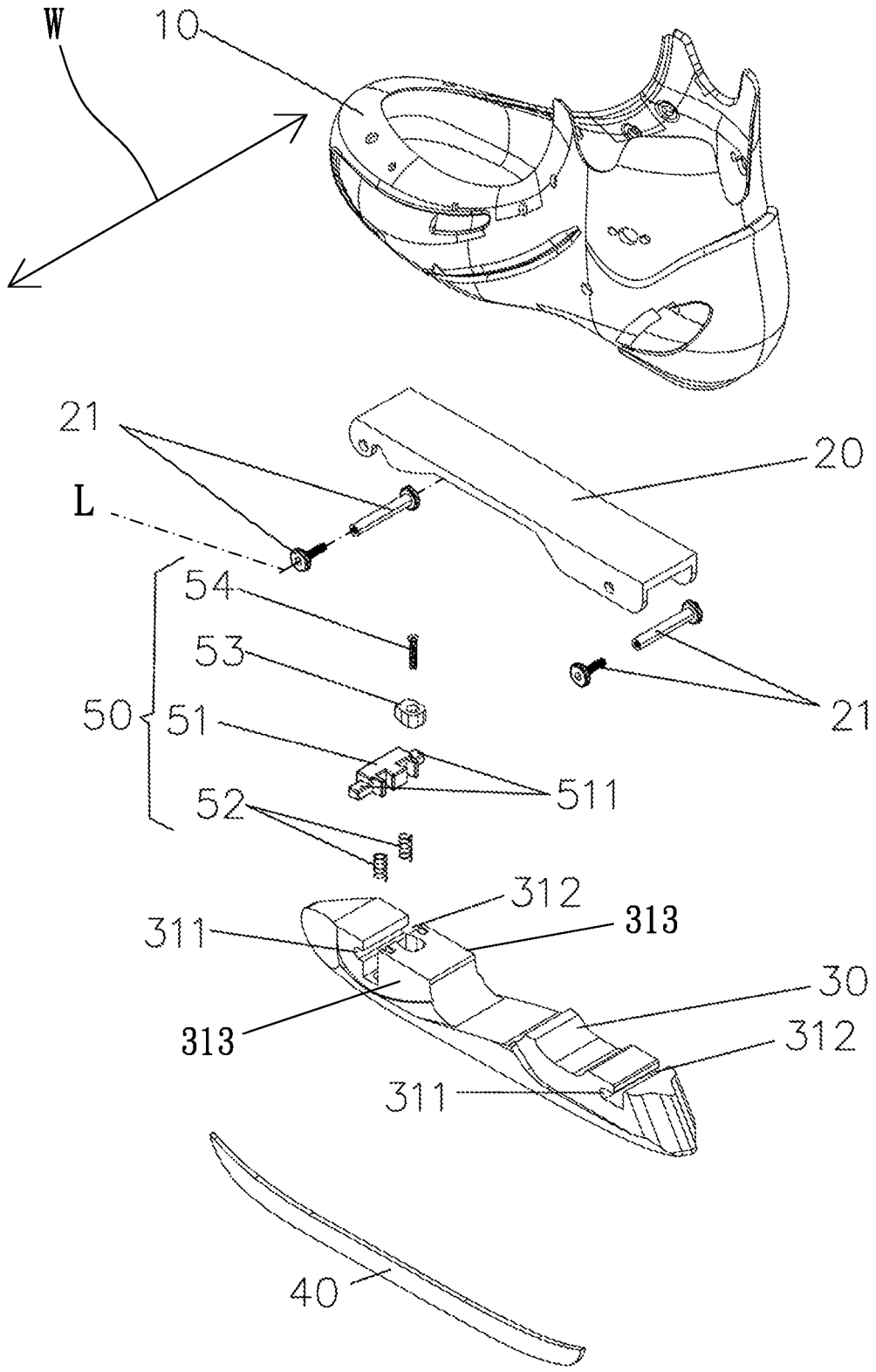
FIG. 1 is an exploded view of an ice skate according to a first preferred embodiment of the invention.
Figure 2:
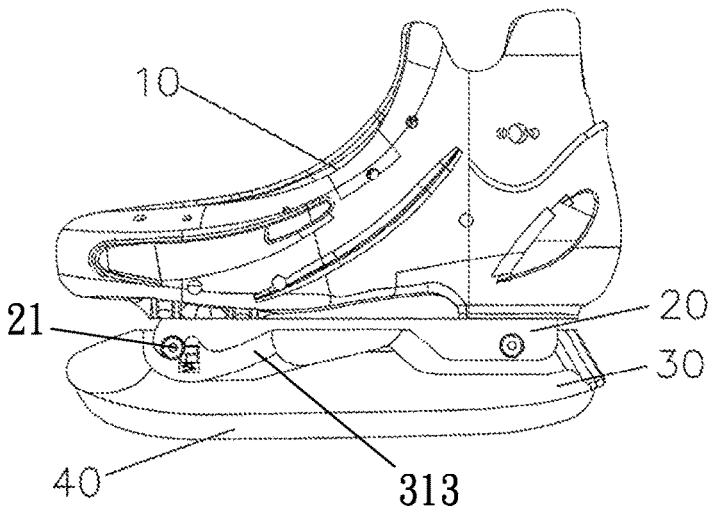
FIG. 2 is a side elevation of the assembled ice skate.
Figure 3:
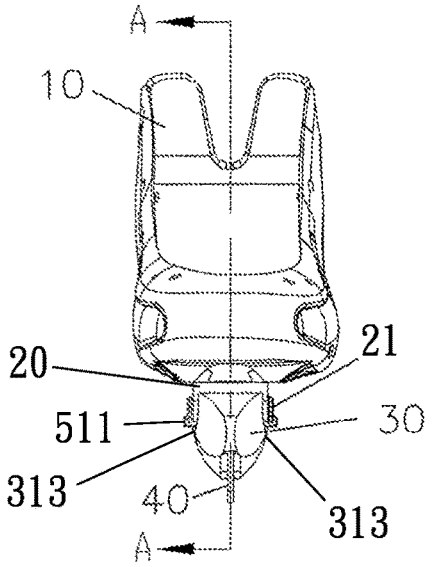
FIG. 3 is a front view of FIG. 2.
Figure 4:
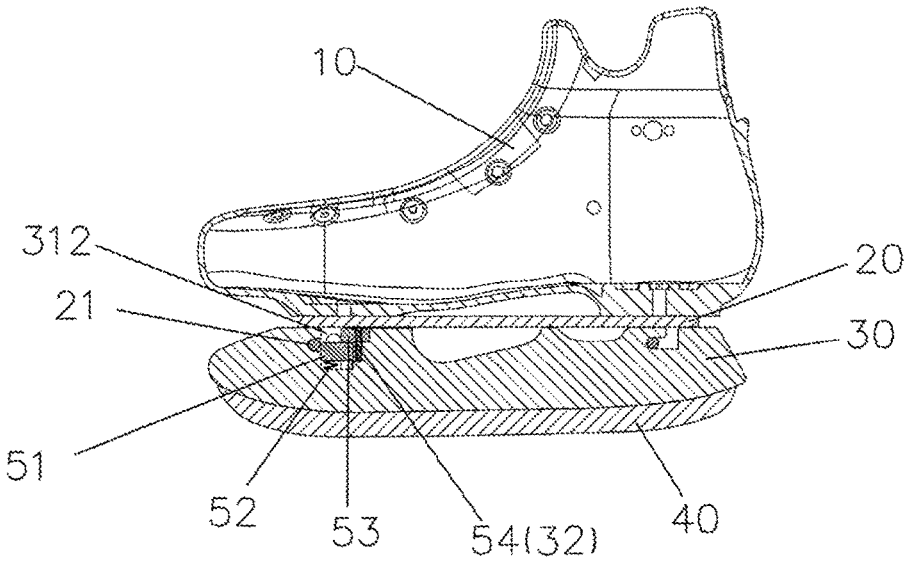
FIG. 4 is a sectional view taken along line A-A of FIG. 3.

Referring to FIGS. 1 to 4, an ice skate in accordance with a first preferred embodiment of the invention comprises a boot 10, a base 20, a frame 30, an ice blade 40 and a locking device 50 as discussed in detail below.

The boot 10 defines a widthwise direction W. The inverted groove-shaped base 20 is secured to the boot 10 and includes two pins 21. The frame 30 includes front and rear sets of a transverse inner groove 311 and a transverse open groove 312 communicating with the transverse inner groove 311, and the frame 30 further includes two lateral sides 313 opposite in the widthwise direction W. Either pin 21 is disposed in the transverse inner groove 311 after disposing through two sides of the base 20 and passing through the transverse open groove 312. Thus, the frame 30 abuts a bottom of a top of the base 20. The ice blade 40 is secured to a bottom of the frame 30. In this embodiment, the frame 30 is an elongated frame extending in a direction lateral to the widthwise direction W, and either pin 21 is disposed in the transverse inner groove 311 and projects out of the two lateral sides 313 of the frame 30 in the widthwise direction W. Specifically, each of the transverse inner groove 311 and the transverse open groove 312 extends through the frame 30 along the widthwise direction W and is parallel to an axial direction L of one of the two pins 21 that is disposed in the transverse inner groove 311.

The locking device 50 as the subject of the invention is disposed in the transverse open groove 312 of the front set and includes a block member 51 disposed in the transverse open groove 312 of the front set and having two projections 511 at two ends respectively, the projections 511 extending oppositely and projecting out of the two lateral sides 313 of the frame 30 in the widthwise direction W from two ends of the transverse open groove 312 of the front set respectively, two compression springs 52 having a bottom urging against a bottom of the transverse open groove 312 of the front set and a top urging against the block member 51, a positioning member 53, and a screw 54 driven through the positioning member 53 into a threaded hole 32 of the frame 30 to fasten the positioning member 53 in the transverse open groove 312 of the front set. Thus, the block member 51 abuts the front pin 21 to block same in an assembled state. Additionally, a dual side release configuration is provided, which can be operated by using two fingers from the two lateral sides 313 of the frame 30. Since the two pins 21 are fixed inside the frame 30, the two pins 21 can sufficiently spread the shear force on each side of the frame 30 across the width of the frame 30 and can effectively prevent the skate from separating under shear forces.

A wearer may remove the rear pin 21 from the transverse inner groove 311 of the rear set and remove the rear pin 21 from the transverse open groove 312 of the rear set sequentially. Next, the wearer may lift a rear portion of the base 20 by pivoting about the front pin 21 until the block member 51 is sufficiently exposed. Next, the wearer may use their fingers to press the projections 511 with the compression springs 52 being compressed until the transverse inner groove 311 of the front set is not blocked by the block member 51. Further, the wearer may remove the front pin 21 from the transverse inner groove 311 of the front set and remove the front pin 21 from the transverse open groove 312 of the front set sequentially. As a result, the base 20 and the frame 30 are detached.

Steps reverse to the above steps can assemble the base 20 and the frame 30.

Figure 5:
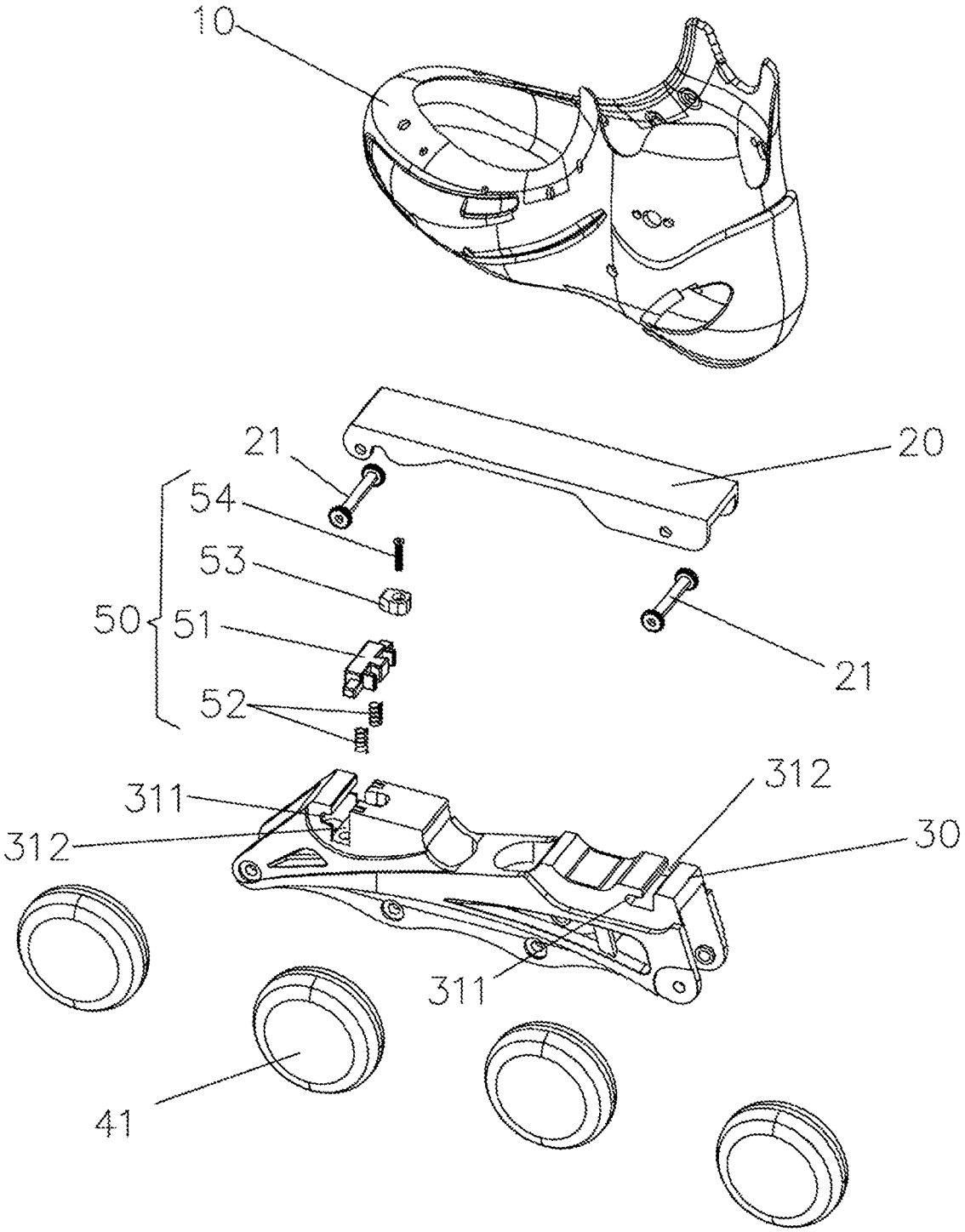
FIG. 5 is an exploded view of an inline skate according to a second preferred embodiment of the invention.

Referring to FIG. 5, an inline skate in accordance with a second preferred embodiment of the invention is shown. The characteristics of the second preferred embodiment are substantially the same as that of the first preferred embodiment except the following: the ice blade 40 is replaced by four wheels 41 arranged inline.

Figure 6:
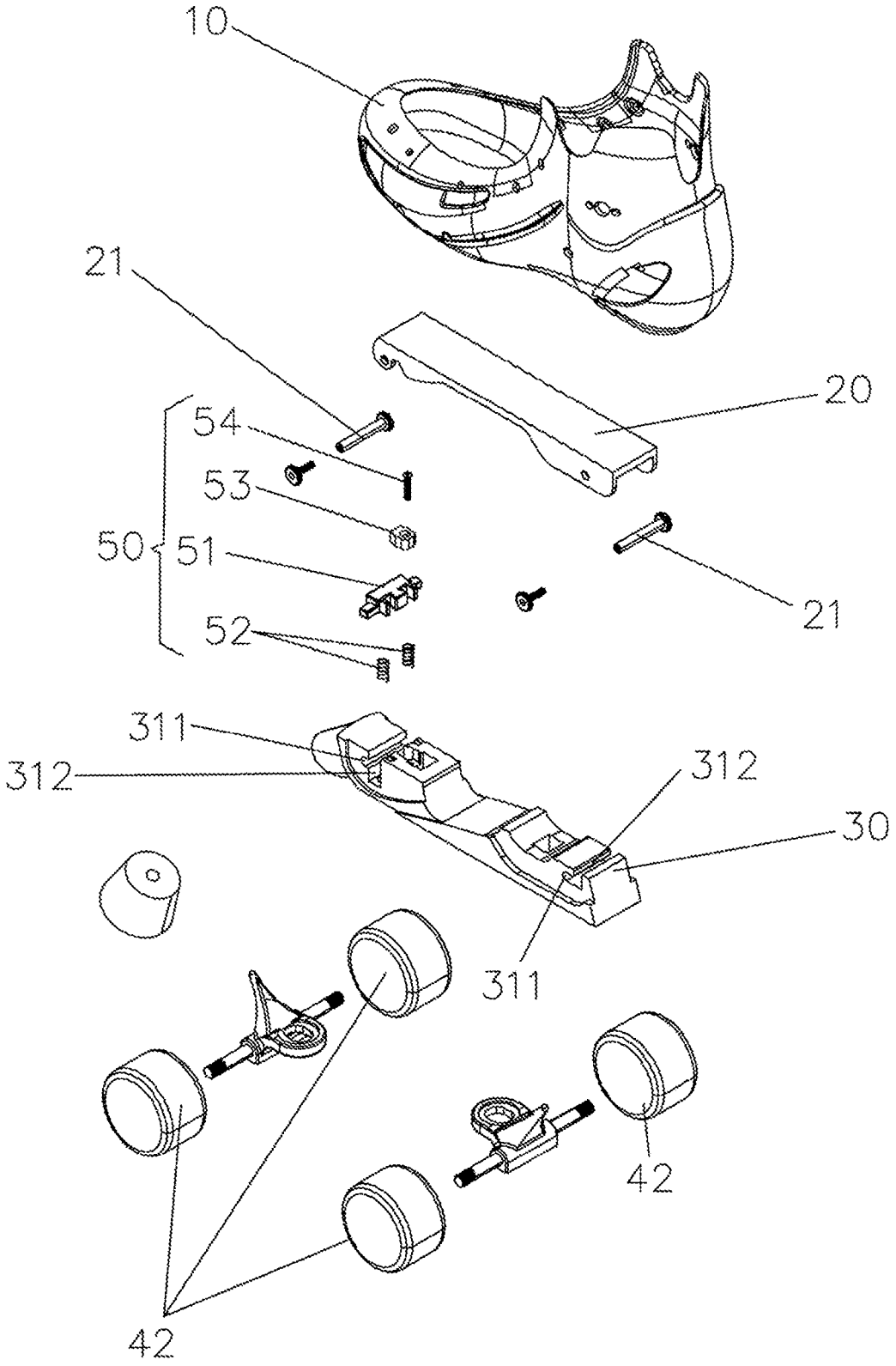
FIG. 6 is an exploded view of a roller skate according to a third preferred embodiment of the invention.

Referring to FIG. 6, a roller skate in accordance with a third preferred embodiment of the invention is shown. The characteristics of the third preferred embodiment are substantially the same as that of the first preferred embodiment except the following: the ice blade 40 is replaced by two front wheels 42 arranged in a front, transverse, straight line and two rear wheels 42 arranged in a rear, transverse, straight line.

While the invention has been described in terms of preferred embodiments, those skilled in the art will recognize that the invention can be practiced with modifications within the spirit and scope of the appended claims.

What is claimed is:

1. A skate, including:

a boot defining a widthwise direction;

an inverted groove-shaped base secured to the boot and including front and rear pins;

an elongated frame including front and rear sets of a transverse inner groove and a transverse open groove communicating with the transverse inner groove, and a threaded hole on the transverse open groove of the front set wherein either the front pin or the rear pin is disposed in the transverse inner groove and the elongated frame abuts an underside of the base, wherein the elongated frame further includes two lateral sides opposite in the widthwise direction, each of the transverse inner groove and the transverse open groove extends through the elongated frame along the widthwise direction and is parallel to an axial direction of one of the front pin and the rear pin that is disposed in the transverse inner groove;

ground engaging means secured to the elongated frame; and a locking device including a spring biased block member disposed in the transverse open groove of the front set and having two projections at two ends respectively, the projections extending oppositely and projecting out of the two lateral sides of the elongated frame in the widthwise direction from two ends of the transverse open groove of the front set respectively, a positioning member partially disposed on the spring biased block member, and a threaded fastener driven through the positioning member into the threaded hole to fasten the positioning member in the transverse open groove of the front set so that the block member abuts the front pin to block same in an assembled state.

2. The skate of claim 1, wherein the ground engaging means is an ice blade.

3. The skate of claim 1, wherein the ground engaging means is a plurality of inline wheels.

4. The skate of claim 1, wherein the ground engaging means is two inline front wheels and two inline rear wheels.

5. The skate of claim 1, wherein either the front pin or the rear pin is disposed in the transverse inner groove and projects out of the two lateral sides of the elongated frame in the widthwise direction.

* * * * *